US005378327A

United States Patent [19]

Sekhar et al.

[11] Patent Number: 5,378,327

[45] Date of Patent: Jan. 3, 1995

[54] TREATED CARBON CATHODES FOR ALUMINUM PRODUCTION, THE PROCESS OF MAKING THEREOF AND THE PROCESS OF USING THEREOF

[75] Inventors: J. A. Sekhar, Cincinnati, Ohio; T. Zheng, deceased, late of Cincinatti, Ohio, by Liming Cai, legal representative; J. J. Duruz, Geneva, Switzerland

[73] Assignee: Moltech Invent S.A., Luxembourg

[21] Appl. No.: 236,232

[22] Filed: May 2, 1994

Related U.S. Application Data

[63] Continuation of Ser. No. 28,384, Mar. 9, 1993, abandoned.

[51] Int. Cl.[6] ..... C25C 3/06; C25C 3/08

[52] U.S. Cl. ..... 204/67; 204/290 R; 204/291; 204/294; 204/243 R; 204/130; 427/126.1; 427/190; 264/105; 252/506

[58] Field of Search ..... 204/290 R, 291, 294, 204/130, 243 R; 427/126.1, 126.3, 190; 264/105; 373/88; 313/326; 252/503, 504, 506, 510, 502

[56] References Cited

U.S. PATENT DOCUMENTS

| | | | |
|---|---|---|---|
| 3,090,094 | 5/1963 | Schwartzwalder et al. | 25/156 |
| 3,097,930 | 7/1963 | Holland | 25/156 |
| 3,111,396 | 11/1963 | Ball | 25/156 |
| 3,345,440 | 10/1967 | Googin et al. | 264/29 |
| 3,705,791 | 12/1972 | Bredzs | 29/195 |
| 3,726,643 | 4/1973 | Merzhanov et al. | 423/409 |
| 3,778,249 | 12/1973 | Benjamin et al. | 25/5 BC |
| 3,893,917 | 7/1975 | Pryor et al. | 210/69 |
| 3,947,363 | 3/1976 | Pryor et al. | 210/510 |
| 3,962,081 | 6/1976 | Yarwood et al. | 210/69 |
| 4,024,056 | 5/1977 | Yarwood et al. | 210/69 |
| 4,052,288 | 10/1977 | Sala | 204/294 |
| 4,081,371 | 3/1978 | Yarwood et al. | 210/69 |
| 4,217,948 | 8/1980 | Merzhanov et al. | 164/115 |
| 4,257,810 | 3/1981 | Narumiya | 106/42 |
| 4,258,099 | 3/1981 | Narumiya | 428/311 |
| 4,312,718 | 1/1982 | Watanabe et al. | 204/60 |
| 4,374,761 | 2/1983 | Ray | 252/519 |
| 4,391,918 | 7/1983 | Brockmeyer | 501/127 |
| 4,405,433 | 9/1983 | Payne | 204/225 |
| 4,455,211 | 6/1984 | Ray et al. | 204/293 |
| 4,459,363 | 7/1984 | Holt | 501/96 |
| 4,466,996 | 8/1984 | Boxall et al. | 204/67 |
| 4,596,637 | 6/1986 | Kozarek et al. | 204/67 |
| 4,600,481 | 7/1986 | Sane et al. | 204/67 |
| 4,678,548 | 7/1987 | Brown | 204/67 |
| 4,678,760 | 7/1987 | Ray | 501/96 |
| 4,680,094 | 7/1987 | Duruz | 204/67 |

(List continued on next page.)

FOREIGN PATENT DOCUMENTS

| | | |
|---|---|---|
| 0126555 | 11/1984 | European Pat. Off. . |
| 0192602 | 8/1986 | European Pat. Off. . |
| 0404943 | 1/1991 | European Pat. Off. . |
| 1173804 | 3/1959 | France . |

OTHER PUBLICATIONS

J. W. McCauley et al. "Simultaneous Preparation . . . ", Ceramic Engineering, 3 (1982), pp. 538–554.

R. W. Rice et al. "Effects of Self-Propagating . . . " Ceramic Engineering, 7 (1986), pp. 737–749.

H. C. Yi, Journal Materials Science, 25 (1990) pp. 1159–1168.

C. H. Samans "Powder Metallurgy", American Society For Metals, Metals Handbook, 1948, pp. 47–52.

*Primary Examiner*—Kathryn Gorgos

*Attorney, Agent, or Firm*—Frost & Jacobs

[57] ABSTRACT

To improve its resistance to penetration and degradation by sodium, a carbon cathode for use in aluminium production by the electrolysis of alumina dissolved in a cryolite-based molten electrolyte is pre-treated with a solution, suspension or melt of a compound of lithium, sodium and/or potassium. This pre-treatment takes place prior to, during or after forming the cathode but before use thereof. The entire carbon cathode, or only that part of the carbon which is nearest to the active cathode surface is treated, making it more resistant to penetration by components of the molten electrolyte of aluminium.

29 Claims, No Drawings

U.S. PATENT DOCUMENTS 4,697,632 10/1987 Lirones ..... 164/369
4,699,763 10/1987 Sinharoy et al. ..... 419/11
4,710,348 12/1987 Brupbacher et al. ..... 420/129
4,747,873 5/1988 Kamioka ..... 75/229
4,751,048 6/1988 Christodoulou et al. .
4,772,452 9/1988 Brupbacher et al. ..... 420/129
4,774,052 9/1988 Nagle et al. ..... 420/129
4,800,065 1/1989 Christodoulou et al. ..... 420/129
4,808,372 2/1989 Koczak et al. ..... 420/457
4,836,982 6/1989 Brupbacher et al. ..... 420/129
4,865,701 9/1989 Beck et al. ..... 204/67
4,900,698 2/1990 Lundsager ..... 501/80
4,902,457 2/1990 Wada et al. ..... 264/43
4,904,424 2/1990 Johnson ..... 264/566
4,909,842 3/1990 Dunmead et al. ..... 75/236
4,915,903 4/1990 Brupbacher et al. ..... 429/128
4,915,905 4/1990 Kampe et al. ..... 420/418
4,948,676 8/1990 Darracq et al. ..... 428/539
4,948,761 8/1990 Hida ..... 501/89
4,957,885 9/1990 Hida ..... 501/89
4,961,778 10/1990 Pyzik et al. ..... 75/230
4,965,044 10/1990 Miyamoto et al. ..... 419/12
4,975,191 12/1990 Brockmeyer et al. ..... 210/510
4,985,202 1/1991 Moshier et al. ..... 420/590
4,988,480 1/1991 Merzhanov et al. ..... 419/11
4,990,295 2/1991 Hida ..... 264/65
5,006,290 4/1991 Hida ..... 264/65
5,015,343 5/1991 LaCamera et al. ..... 204/67
5,022,991 6/1991 Day et al. ..... 210/506
5,030,600 7/1991 Hida et al. ..... 501/98
5,032,332 7/1991 Hida et al. ..... 214/65
5,069,764 12/1991 Watanabe et al. ..... 204/291
5,071,533 12/1991 de Nora et al. ..... 204/243
5,071,797 12/1991 Hida ..... 501/87
5,143,668 9/1992 Hida ..... 264/63
5,145,619 9/1992 Abramovici ..... 264/60
5,149,677 9/1992 Merzhanov et al. ..... 501/96
5,158,655 10/1927 Townsend ..... 204/67
5,188,678 2/1993 Sekhar et al. ..... 148/514
5,217,583 6/1993 Sekhar et al. ..... 204/67

TREATED CARBON CATHODES FOR ALUMINUM PRODUCTION, THE PROCESS OF MAKING THEREOF AND THE PROCESS OF USING THEREOF

This is a continuation of application Ser. No. 08/028,384, filed Mar. 9, 1993, now abandoned.

FIELD OF THE INVENTION

The invention relates to the production of aluminium by the electrolysis of alumina dissolved in a cryolite-based molten electrolyte in electrolytic cells in which cathodes and other cell components made of carbonaceous material are chemically treated to improve their properties.

BACKGROUND OF THE INVENTION

Aluminium is produced conventionally by the Hall-Héroult process, by the electrolysis of alumina dissolved in a cryolite-based molten electrolyte at temperatures around 950° C. A Hall-Héroult reduction cell typically has a steel shell provided with an insulating lining of refractory material, which in turn has a lining of carbon which contacts the molten constituents. Conductor bars connected to the negative pole of a direct current source are embedded in the carbon cathode blocks forming the cell bottom floor. The cathode blocks are usually made of an anthracite based prebaked carbon material containing coal tar pitch as a binder joined with a ramming paste mixture of anthracite, coke, and coal tar.

In Hall-Héroult cells, a molten aluminium pool above the carbon blocks acts as the cathode where the reduction to aluminium takes place. The carbon lining or cathode material has a normal useful life of three to eight years, or even less under adverse conditions. The deterioration of the cathode bottom is due to erosion and penetration of electrolyte and liquid aluminium as well as intercalation by sodium, which causes swelling and deformation of the cathode carbon blocks and ramming paste. In additon,-the penetration of sodium species and other ingredients of cryolite or air leads to the formation of toxic compounds including cyanides.

The problems associated-with penetration of sodium into the carbon cathode have been extensively studied and discussed in the literature.

Several papers in Light Metals 1992 published by the Minerals, Metals and Materials Society discuss these problems. A paper "Sodium, Its Influence on Cathode Life in Theory and Practice" by Mittag et al, page 789, emphasizes the advantages of using graphitic carbon over anthracite. Reasons for the superiority of graphitic carbon were also set out in a paper "Change of the Physical Properties and the Structure in Carbon Materials under Electrolysis Test" by Ozaki et al, page 759. Another paper "Sodium and Bath Penetration into $TiB_2$ Carbon Cathodes During Laboratory Aluminium Electrolysis" by Xue et al, page 773, presented results showing that the velocity of sodium penetration increased with increasing $TiB_2$ content in a $TiB_2$ graphite matrix. Another paper "Laboratory Testing of the Expansion Under Pressure due to Sodium Intercalation in Carbon Cathode Materials for Aluminium Smelters" by Peyneau et al, page 801, also discusses these problems and describes methods of measuring the carbon expansion due to intercalation. From another paper by Smith et al entitled "The Effect of Pitch Sodium Content Compared to Sodium Additions Through Butts", page 593, it is known that the use of soda in the production of coal tar pitch used to make pre-baked carbon anodes for aluminium production leads to residual sodium in the anode binder, and this was related to increased consumption of the carbon anodes. The presence of such residual sodium was therefore considered to be undesirable.

A reduction of the expansion rate due to sodium penetration by exposing carbon to lithium vapor was studied by Oye and co-workers, Light Metals 1982, p. 311–324 but this has led to no practical implementation in commercial cells.

Richards, in a paper "Aspects of Interaction of LiF-Modified Bath with Cathodes" presented at the 121st TMS Annual Meeting San Diego, Mar. 1–5 1992, demonstrated the influence of using a LiF-modified cryolite electrolyte, leading to improved cathode life and reduction in the destructive thermomechanical and chemically induced forces during the first hours of operation.

There have been several attempts to avoid or reduce the problems associated with the intercalation of sodium in carbon cathodes in a]-uminium production.

Some proposals have been made to dispense with carbon and instead use a cell bottom made entirely of alumina or a similar refractory material, with a cathode current supply arrangement employing composite current feeders using metals and refractory hard materials. See for example, EP- B-0 145 412, EP-A-0 215 555, EP-B-0 145 411, and EP-A-0 215 590. So far, commercialization of these promising designs has been hindered due to the high cost of the refractory hard materials and difficulties in producing large pieces of such materials.

Other proposals have been made to re-design the cell bottom making use of alumina or similar refractory material in such a way as to minimize the amount of carbon used for the cathode - see U.S. Pat. Nos. 5,071,533 and 5,135,621. Using these designs will reduce the problems associated with carbon, but the remaining carbon is still subject to attack by sodium already during cell start up.

There have been numerous proposals to improve the carbon materials by combining them with $TiB_2$ or other refractory hard materials, see e.g. U.S. Pat. No. 4,466,996. But, as pointed out in the above-mentioned paper of Xue et al, with such composite materials, the penetration increases with increasing $TiB_2$ content.

Co-pending application Ser. No. 07/861,513 proposes applying a protective coating of refractory material to a carbon cathode by micropyretic methods by applying a layer from a slurry containing particulate reactants in a colloidal carrier. To assist rapid wetting of the cathode by molten aluminium, it was proposed to expose the coated cathode to a flux of molten aluminium containing a fluoride, a chloride or a borate of lithium and/or sodium. This improves the wetting of the cathode by molten aluminium, but does not address the problem of sodium attack on the carbon, which is liable to be increased due to the presence of $TiB_2$.

As mentioned above, graphitic forms of-carbon seem to be preferable to anthracite, but these forms of carbon are relatively expensive and in particular the use of inexpensive low-density carbon as a cathode is ruled out on account of excessive attack by sodium as well as other detrimental properties such as low electrical conductivity.

Also, as mentioned above, the use of a lithium-containing electrolyte has been found to reduce somewhat the start up problems and increase the cathode life, but the problems still remain significant.

No adequate solution has yet been proposed to eliminate or substantially reduce the problems associated with sodium penetration in carbon cathodes, namely swelling especially during cell start-up, displacement of the carbon blocks leading to inefficiency, reduced lifetime of the cell, the production of large quantities of toxic products that must be disposed of when the cell has to be overhauled, and the impossibility to use low density carbon.

SUMMARY OF THE INVENTION

The primary object of the present invention is to provide pre-treated carbon cathodes for aluminium production having improved resistance to penetration by molten electrolyte components, in particular penetration by sodium and also penetration of cryolite.

It is another object of the present invention to provide pre-treated carbon cathodes for aluminium production wherein the degradation of pitch in the cathode caused by sodium is prevented or substantially reduced.

It is yet another object of the present invention to provide pre-treated carbon cathodes for aluminium production wherein direct attack of the carbon by cryollie is prevented.

It is a further object of the present invention to provide pre-treated carbon cathodes for aluminium production which have better wettability by molten aluminium but are less wettable by cryolite, giving an overall better protection of the carbon cathode.

It is a still further object of the present invention to provide improved lithium pre-treated carbon cathodes for aluminium production with a form of lithium which reacts with carbon preferably to sodium with consequent less expansion of the carbon.

It is also an object of the present invention to provide pre-treated carbon cathodes for aluminium production which cathodes are less toxic to dispose of than prior art untreated cathodes, with great advantages to the environment.

It is a primary aspect of the present invention to provide a method of producing an improved carbon cathode for use in aluminium production by the electrolysis of alumina dissolved in a cryolite-based molten electrolyte, the method comprising the step of: treating the carbon to absorb at least one compound of at least one metal selected from lithium, sodium and potassium from a solution, suspension or melt, before the cathode is used for the production of aluminium.

It is another aspect of the present invention to provide a carbon cathode for use in aluminium production by the electrolysis of alumina dissolved in a cryolite-based molten electrolyte, wherein the carbon is treated to absorb at least one compound of at least one metal selected from lithium, sodium and potassium from a solution, suspension or melt, before the cathode is used for the production of aluminium.

It is a further aspect of the present invention to provide a method of producing a carbon cathode for use in aluminium production by the electrolysis of alumina dissolved in a cryolite-based molten electrolyte, the method comprising: treating the carbon absorb at least one compound of at least one metal selected from lithium, sodium and potassium from a solution, suspension or melt, during the formation of said cathode.

It is a still further aspect of the present invention to provide an improved method of producing aluminium by the electrolysis of alumina dissolved in a cryolite-based melt, the improved method comprising: using a carbon cathode wherein the carbon is treated to absorb at least one compound of at least one metal selected from lithium, sodium and potassium from a solution, suspension or melt, prior to, during of after forming the cathode, but before the cathode is used for the production of aluminium.

It is also an aspect of the present invention to provide an improved electrolytic cell for producing aluminium by the electrolysis of alumina dissolved in a cryolite-based molten electrolyte, comprising: a carbon cathode in contact with the product aluminium, wherein the carbon is treated before use of the cathode to absorb at least one compound of at least one metal selected from lithium, sodium and potassium from a solution, suspension or melt, before the cathode is used for the production of aluminium.

It is yet another aspect of the present invention to provide a method of conditioning a carbon cathode for use in aluminium production by the electrolysis of alumina dissolved in a cryolite-based molten electrolyte, so as to improve the resistance of the cathode to penetration by melt components, the method comprising: treating the carbon to absorb at least one compound of at least one metal selected from lithium, sodium and potassium from a solution, suspension or melt, prior to, during or after forming the cathode, but before the cathode is used for the production of aluminium.

It is another aspect of the present invention to provide a method of reconditioning an electrolytic cell for producing aluminium by the electrolysis of alumina dissolved in a cryolite-based molten electrolyte, wherein a carbon cathode in contact with the product aluminium is replaced or reconditioned after shutting down the cell. In this method, the carbon is treated to absorb at least one compound of at least one metal selected from lithium, sodium and potassium from a solution, suspension or melt, prior to, during or after forming a replacement cathode or reconditioning the used cathode, but before re-starting operation of the reconditioned cell.

These and other objects and aspects of the invention will become apparent from the following description of the preferred embodiments.

DETAILED DESCRIPTION OF PREFERRED EMBODIMENTS

As set out in the claims, the invention eliminates or reduces the aforementioned problems of sodium intercalation in these carbon cathodes by treating the carbon making up the cathode (or at least that part of the carbon which is nearest to the active cathode surface exposed to the molten aluminium) to absorb at least one compound of at least one metal selected from lithium, sodium and potassium from a solution, suspension or melt. This treatment is carried out prior to, during or after forming the cathode, or even after installation of the cathode, but before use of the cathode, and preferably with a simultaneous or subsequent heat treatment. During cell start-up, the treated carbon cathode is not subject to attack by sodium, because after treatment of the carbon, the sites where sodium from the molten aluminiium could attack and react with the carbon are already taken up by the impregnated lithium, sodium or potassium.

This treatment achieves the aforementioned objects and in particular prevents direct attack of the carbon by cryolite. This has been demonstrated by immersing pretreated and non-treated carbon in molten cryolite for several hours in conditions simulating an electrochemical cell. The pre-treated carbon was found to be attacked much less than the non-pre-treated carbon. Attack by cryolite hardens the carbon and reduces its electrical conductivity. This is avoided by the treatment according to the invention. Moreover, it has been observed that the treated material has enhanced wettability by molten aluminium and reduced wettability by molten cryolite.

It has also been observed that, up to a certain percentage of impregnated lithium, the lithium treatment increases the electrical conductivity of the carbon. In addition, treatment with lithium acetate has been found to improve the elastic modulus of the carbon by 10%.

Molten salts used to treat the carbon may comprise one or more of:lithium acetate, lithium carbonate, a mixture of lithium fluoride and lithium chloride, anhydrous lithium chloride, lithium oxalate, lithium nitride, lithium formate and lithium aryl, lithium tetraborate; sodium acetate, a mixture of sodium fluoride and sodium chloride, sodium oxylate, sodium formate, sodium aryl and sodium sulfate; or potassium chloride, as molten salt or dissolved in a solvent, usually an aqueous solvent. When molten mixtures of two or more of such salts are used, they are preferably eutetic mixtures.

The treatment can also be carried out with aqueous or non-aqueous solutions of fluorides and chlorides of the lithium, sodium or potassium, as well as other compounds including hydroxides, borates, etc. Suspensions include a suspension of lithium tetraborate.

When a molten salt is used, the temperature must be above the melting point of the salt, which is 58° C. for lithium acetate dihydrate and. 600° C. for an eutectic mixture of lithium fluoride and lithium chloride. The time of treatment can be established empirically to obtain sufficient impregnation, usually half an hour or more. Treatment in the molten salt can be followed by an optional heat treatment to promote reaction of the lithium, sodium or potassium with the carbon before use as cathode in an aluminium production cell, or heat treatment can be carried out in-situ when the cathode is inserted in the ceil and heated to about 960° C. or a lower temperature.

For aqueous or other solutions or suspensions of the lithium, sodium and potassium compound, the carbon can simply be immersed by dipping, and the solvent allowed to evaporate or removed by heat treatment. The treated carbon can be used directly in an aluminium production cell, or can be heat treated prior to introduction and use in a cell.

For molten salt immersion, the treatment can be electrolytically assisted by cathodically polorizing the carbon body or mass in the solution or melt of the lithium, sodium or potassium salt, and passing a constant or pulsed electrolysis current at suitable low current density using a suitable anode. In this treatment, the electrolyte is lithium, sodium or potassium salt which directly contacts the carbon being treated. This provides an optimum treatment with deposition of e.g. lithium metal on the carbon surface, which simulates the conditions during later use. Such electrolytic pre-treatment is different to the normal conditions of subsequent use of the carbon cathode in an aluminium production cell, where the carbon cathode is in contact with a pool of produced aluminium and the sodium species from the alumina-containing electrolyte reach the cathode only via the aluminium pool.

During the treatment, or possibly during subsequent treatment steps, one or more compounds with carbon may be formed, for instance the carbon-rich lamellar ccmpounds $LiC_m$ where m is 2, 4, 6, 12, 18, 36, 64 or 72, as well as $NaC_{24}$ or $NaC_{64}$. Not all of the treatment metal need be reacted, and usually, there will be an excess of unreacted treatment metal impregnated in the carbon. In particular, the formation of lithium acetylite ($Li_2C_2$) has been established. Further, lithium-carbon compounds may also be formed.

The term carbon cathode is meant to include bcth preformed carbon blocks ready to be assembled into a cathode in the bottom of an aluminium production cell, as well as installed cathodes forming the cell bottom and the carbon side walls extending up from the bottom and which are also cathodically polarized and therefore subject to attack by sodium from the molten cell content.

The treatment of the invention may be applied to the carbon making up the entire cathode, but in any event that part of the carbon which is nearest to the active carbon surface and, thus, is liable to attack from melt components, is treated.

The electrolytically-assisted treatment can be carried out in a special cell in the case of pre-formed carbon blocks, or carbon in a form to be processed into a cathode. The treatment can also be indirectly extended if lithium from the treated carbon dissolves in the cryolite and leads to reprecipitation during normal aluminium electrolysis or in any other electrolytic treatment.

When the electrolytically-assisted treatment is carried out on an assembled cell bottom of an aluminium production cell, it can be carried out as part of a special start-up procedure, using for example a lithium salt electrolyte. After electrolytically-assisted treatment, this lithium salt electrolyte is removed and the cell filled with aluminium and the standard cryolite-alumina electrolyte for normal cell start-up and operation.

When a sodium salt is used, the carbon should be treated prior to installation of the cathode, since treatment of a pre-formed and installed cathode with a sodium salt would be liable to produce undesirable swelling, as occurs with the known cathodes during use, and which the invention precisely aims to eliminate.

Treatment with lithium salts, however, does not lead to any appreciable swelling of the carbon, making it possible to treat a pre-formed cathodic carbon cell lining or preformed carbon blocks with lithium salt(s) without any risk of swelling.

When the carbon is treated before installation of the cathode or cathode block, sodium and potassium salts can be used, too, as well as lithium salts, because dimensional changes in the treated carbon can be accomodated before installation of the cathode in its fabricated shape and dimensions.

Pitch used to bond carbon particles to form the cathode may be treated with the lithium, sodium or potassium salt or salt mixture prior to mixing the pitch with particulate carbon, shaping and calcining.

Carbon particles can also be treated prior to compacting the particles to form the entire cathode or its surface part.

Pitch and carbon particles, both treated according to the invention, can also be mixed together and processed in the usual way by shaping and calcining to form entire cathode blocks, or their operative surface part.

Carbon particles treated with the molten salt may be applied as a coating onto a carbon cathode, either a new pre-formed carbon block or a reconditioned carbon cathode. The treated carbon particles can be mixed with other materials and the mixture applied as a coating onto a carbon cathode.

The treated carbon can also be used in ramming paste used to join the carbon blocks forming the cell bottom.

In accordance with the teachings of co-pending application Ser. No. 07/897,726, the contents whereof are incorporated herein by way of reference, the treated carbon particles may be included in a paste together with a non-carbonaceous non-polluting binder which is a suspension of one or more colloids or is derived from one or more colloid precursors, colloid reagents or chelating agents.

The binder may advantageously be a suspension containing colloidal silica, alumina, yttria, ceria, thoria, zirconia, magnesia, lithia and related hydroxides, acetates and formates thereof, as well as oxides and hydroxides of other metals, cationic species and mixtures thereof. The colloidal binder can also be derived from a suspension containing colloid precursors and reagents as discussed in the aforementioned application Ser. No. 07/897,726.

The colloidal binder will usually be a relatively dilute aqueous or non-aqueous suspension, but the use of concentrated colloids or partly or fully precipitated colloids is also possible. Alternatively, the colloidal binder is derived from a suspension containing also chelating agents such as acetyl acetone and ethylacetoacetate.

This paste may comprise one or more fillers selected from metallic, intermetallic, semi-metallic, polymeric, refractory and/or ceramic materials such as borides, carbides, nitrides, silicides, oxides, oxynitrides, as well as pyrolyzable chlorosilanes, polycarbosilanes, polysilanes and other organometallic polymers which pyroiyze to useful products for oxidation prevention or enhancing bonding, or their pyrolyzed products; thermoserring resins; thermoplastic resins; and mixtures thereof. Examples cf thermoserring resins are epoxides, phenolic resins and polyimides. Examples of thermoplastic resins are polycarbonates, e.g. Lexan TM, polyphenylene sulfides, polyether ether ketones, polysulfones, e.g. Udel TM, polyetherimides and polyethersulfones.

Some materials may be present both as binders and as fillers. For instance, alumina in colloidal form can be present in the binder, while particulate alumina is included as a filler.

The particulate carbonaceous materials to be treated are preferably selected from petroleum coke, metallurgical coke, anthracite, graphite or any other form of crystalline carbon, amorphous carbon or a mixture thereof, preferably anthracite, metallurgical coke, graphite and other carbon materials. Additionally, the carbon may be a fulerene such as fulerene $C_{60}$ or $C_{70}$ or of a related family. Mixtures of these different forms of carbon can also be used.

The size of the particulate carbonaceous material is usually below 40 mm, preferably between 1 micrometer and 30 mm, and the particulate carbonaceous material preferably contains between 5 weight % and 40 weight % of particles having a size below 0.2 mm.

However, the paste may contain treated particulate carbonaceous material, fillers or binders that are fibrous, both discrete (chopped) fibers and continuous or discontinuous lengths of fibers. Fibers have the advantage of enhancing bonding and improving toughness, hence the solidity of the resulting bodies or masses. Mixtures of powders and fibers are also contemplated.

The paste can also be used to produce relatively thick fibers (1 to 5 mm diameter), both short fibers and continuous lengths. These pre-formed fibers may then be treated and mixed with the colloidal binder, possibly with treated particulate carbonaceous materials and optional non-carbonaceous fillers, into a paste to produce a fiber-reinforced body.

The particulate or fibrous carbonaceous material is usually treated with the lithium, sodium or potassium salt before mixing it with the binders and optional fillers, but treatment at a later stage of manufacture is also possible.

The paste with treated carbon may for example be compacted by pressing into the desired shape in a mold at a pressure between about 0.1 to 2 tons/cm$^2$, or may be compacted by vibration and/or the application of pressure in a mold or extrusion die of the desired shape and size. The compaction may also be carried out by tamping the paste in a cell bottom acting as mold.

Optionally, the treated particulate carbonaceous material is mixed with a filler before mixing with the binder to form the paste. If necessary, the treated carbonaceous material is dried before mixing with the fillers. Also, the paste can be partially dried before molding, compacting and subjection to heat treatment.

To form self-supporting blocks, the paste of treated carbon is formed into the required shape, compacted and dried. But the paste may also be formed into shape, compacted and dried in an aluminium production cell, thus forming for instance a cell bottom and/or sidewalls in situ.

After making a block or mass with treated carbon, the block or mass may be subjected to an additional treatment of a colloid based slurry and heated and/or treated again with a lithium, sodium or potassium salt.

The paste including treated carbon can also be applied to pre-forms of carbonaceous materials, atuminium, alumina or other refractory materials, in the form of honeycombs, reticulated foams, fabrics, felts, etc. which serve as a core or as a reinforcement for the finished body.

Usually, the paste contains 50 to 99 weight % of treated carbonaceous materials (preferably 50 to 95%), 0 to 30 weight % of fillers and 1 to 30 weight % of the binder (preferably 5 to 30%). The mentioned weights of the binders are in the dry form; therefore, the same weight proportions apply also to the dried bodies or masses obtained from the paste. The paste containing treated carbon can have different fluidities during its production, handling, storage and transport. Its viscosity may range from about $10^{-1}$ to $10^{15}$ cP, i.e. from quite fluid to solidified masses ready for use. For cost reasons, it is desirable to minimize the quantity of the liquid carrier. Therefore controlled viscous forms of the paste are usually preferred, i.e. with a viscosity in the range $10^1$ to $10^3$ cP.

A formed and treated cathode according to the invention can also be coated with a protective coating, typically containing an aluminium-wettable refractory hard metal compound such as the borides and carbides of metals of Group IVB (titanium, zirconium, hafnium) and Group VB (vanadium, niobium, tantalum).

Such a protective coating may be formed by applying to the treated carbon cathode a micropyretic reaction layer from a slurry containing particulate reactants in a colloidal carrier, and initiating a micropyretic reaction as described in co-pending application Ser. No. 07/861,513, the contents whereof are incorporated herein by way of reference. Such micropyretic slurry comprises particulate micropyretic reactants in combination with optional particulate of fibrous non-reactant fillers or moderators in a carrier of colloidal materials or other fluids such as water or other aqueous solutions, organic carriers such as acetone, urethanes, etc., or inorganic carriers such as colloidal metal oxides. Such coatings may give an additional protection against sodiun attack.

Protective coatings can also be formed from a colloidal slurry or particulate non-reactants, such as Preformed $TiB_2$, as described in copending application Ser. No. 07/898,052, the contents whereof are incorporated herein by way of reference.

When the treated carbon cathode is coated with a refractory coating forming a cathodic surface in contact with the cathodically-produced aluminium, it can be used as a drained cathode. The refractory coating forms the cathodic surface on which the aluminium is deposited cathodicaily usually with the component arranged upright or at a slope for the aluminium to drain from the cathodic surface.

It is advantageous for the cathode to be made of treated low-density carbon possibly protected by a refractory material. Low density carbon embraces various types of relatively inexpensive forms of carbon which are relatively porous and very conductive, but hitherto could not be used successfully as cathodes in aluminium production cells on account of the fact that they were subject to excessive corrosion. Now it is possible by treating these low density carbons according to the invention, to make use of them in these cells instead of the more expensive high density anthracite and graphite, taking advantage of their excellent conductivity and low cost.

Before use of the treated carbon cathodes, it is advantageous to subject the operative cathode surface, coated or not with a protective coating, to an aluminizing treatment by exposing the surface to molten aluminium in the presence of a flux such as cryolite or cryolite containing dissolved alumina. This treatment can be carried out prior to insertion of the cathode in the aluminium production cell, or in situ in the cell prior to normal operation.

Another aspect of the invention is a carbon cathode for use in aluminium production by the electrolysis of alumina dissolved in a cryolite-based melt, wherein the carbon is treated, before use of the cathode, to absorb at least one compound of lithium, sodium or potassium from a solution, suspension or melt.

A further aspect of the invention is the use, in the manufacture of a carbon cathode for aluminium production by the electrolysis of alumina dissolved in a cryolite-based melt, of carbon treated to absorb at least one compound of at least one of lithium, sodium and potassium from a solution, suspension or melt, for making at least that Dart of the cathode nearest to the active cathode surface.

The invention also concerns a menhod of producing aiuminium by the electrolysis of alumina dissolved in molten cryolite in a cell having a treated carbon cathode as set out above; an electrolytic cell for producing aluminium by the electrolysis of alumina dissolved in molten cryolite provided with such a treated cathode; a method of conditioning carbon cathodes for use in such cells; as well as a method of reconditioning these electrolytic cells. The electrolyte may be cryolite or modified forms of cryolite in particular containing LiF, and may be at the usual operating temperature of about 950° C., or lower temperatures.

The feasibility of the invention is demonstrated in the following examples.

EXAMPLE I

A mixture of $LiC_1$ and LiF in a weight ratio 67:33 was put into a clay crucible and placed in a furnace at 600° C. After melting of the mixture, which took about 15 minutes, a carbon cathode sample was placed in the molten lithium salt mixture. After 40 minutes of immersion, the cathode sample was removed and the adhering melt was allowed to solidify. The solidified compounds adhered strongly to the cathode surface; the surface layer of the lithium compounds was removed and the cathode surface gently polished. The presence of Li-C compounds at the cathode surface was established by firing a small sample with a torch, which produced a characteristic orange/blue flame.

EXAMPLE II

A quantity of lithium acetate, melting point 58° C. put into a clay crucible and placed in a furnace at 200° C. After melting of the.acetate, which took about 10 minutes, a carbon cathode sample was placed into the molten lithium acetate. After 40 minutes immersion, the cathode sample was removed and the adhering melt was allowed to solidify. The solidified acetate adhered strongly to the cathode surface, this surface layer was removed and the cathode surface gently polished. The presence of lithium compounds at the cathode surface was established by firing a small sample with a torch, which produced a characteristic orange/blue flame. A comparative x-ray diffraction test of a cathode sample before lithium acetate treatment and after lithium acetate treatment by the method as described was made. The presence of lithium compounds such as $Li_2C_2$ and others was established. The weight gain after treatment was 2%. Also, the lithium acetate treatment increased the modulus of elasticity by 10% and increased electrical conductivity too.

EXAMPLE III

An amount of 10 grams of a lithium tetraborate ($Li_2B_4O_7$) and lithium chloride (LiCl) powder mixture (70:30 wt %) was put into 30 ml of liquid made up of acetone and alcohol (50:50 vol %), and stirred to produce a suspension of lithium tetraborate. A small carbon cathode sample was placed into the suspension and stirred at room temperature. After 15 minutes of immersion, the cathode sample was removed and dried at room temperature for about 30 minutes. Impregation of the sample with lithium compounds was established by cutting the sample and observing a fine powder of lithium compounds under an optical microscope. The presence of lithium at the cathode surface and within the cathode was established by firing a sample with a torch, which produced a characteristic orange/blue flame.

EXAMPLE IV

Lithium chloride powder was dissolved in water and the solution was impregnated into a carbon cathode measuring 4cm×4cm×4cm by dipping the cathode in the solution. The water was then evaporated and the cathode used in a laboratory aluminium production cell at 960° C. in a cryolite bath containing 10 wt % $Al_2O_3$. Compared to a ncn-impregnated carbon cathode, a reduction in Na-related attack was noted.

EXAMPLE V

Example IV was repeated using lithium fluoride powder and a similar result was acheived.

EXAMPLE VI

Carbon cathode samples were impregnated with a solution of lithium acetate dihydrate in water, in amounts of 10 g, 20 g, 30 g and 40 g per 100 ml. TreaEment was carried out at room temperature, then the samples were fully dried at 200° C. for 30 or 60 minutes. The following impregnation data was collected.

TABLE I

| Time | Solution 10 g/100 ml | Solution 20 g/100 ml | Solution 30 g/100 ml | Solution 40 g/100 ml |
|---|---|---|---|---|
| 30 minutes | ~0.2% | ~0.3% | 0.5% | 0.8% |
| 60 minutes | 0.3% | ~0.6% | 0.9% | 1.2% |

EXAMPLE VII

Particulate anthracite (particle size in the ranges 10–100 micrometer) was mixed into an aqueous solution of lithium acetate in water. The water was allowed to evaporate and the lithium-impregnated anthracite particles were added (AL-20 grade, 20 wt % solid alumina) in an amount of 160 ml of colloidal alumina per 100 g of anthracite, and stirred well. The resulting slurry of anthracite and colloid alumina was then dried at 200° C. in an air furnace for approximately 2 hours to produce a paste.

The resulting paste was pressed at 8200 psi into cylinder form. In the pressing process, some liquid was squeezed out. The cylinders thus produced were then heated at 200° C. in an air furnace until dried to form a lithium-impregnated cathode. Some samples were baked in an inert atmosphere (argon) or a reducing atmosphere (CO) at a final temperature of 500° C. and 1000° C. maintained overnight.

The pressed cylinders exhibited good formability: no signs of cracking or tendency to crumble. The dried and baked cylinders had good strength.

The same procedure repeated with the addition of different amounts of colloidal alumina or colloidal cerium acetate instead of colloidal alumina, produces similar results.

The same procedure can be repeated using pitch instead of colloidal alumina, where both the anthracite and pitch are impregnated with a solution of lithium acetate.

The same procedure repeated with porous particles of calcined coke, produces similar results. The calcined coke is impregnated easier with the lithium acetate than the denser anthracite particles.

EXAMPLE VIII

Carbon cathodes impregnated according to Example II and comparable non-impregnated carbon cathodes were subjected to comparative testing in a laboratory aluminium production cell with a cryolite electrolyte containing 8 wt % alumina at 1000° C. Electrolysis was carried out at a nominal anode current density of 1.9 A/cm$^2$, using a carbon anode. After 3 hours, the experiment was terminated and the cathodes examined by optical microscope. No damage was noted on the treated sample whereas the untreated sample was heavily damaged and cracked. By measuring the depth of attack, it is estimated that the untreated sample was attacked 3000% more than the treated one.

EXAMPLE IX

A sample of anthracite measuring approximately 6.5 cc was treated as set out in Example II and then aluminized as follows. An amount of 60 g of aluminium chunks were loaded into a crucible and placed in a furnace at 1000° C. until the aluminium had melted. The crucible was then removed from the furnace and the treated anthracite sample inserted into the molten aluminium. An amount of 20 g of pre-mixed powders of cryolite with 10 wt % alumina was then spread on top of the melt. The crucible was then placed back in the furnace at 1000° C. for 50–96 hours. Aluminization occurs already at 50 hours, but is fuller after the longer period. After removing the sample from the melt, examination shows that the sample surface contains aluminium and is coated with aluminium. On polishing, the surface becomes shiny.

EXAMPLE X

A sample of anthracite was coated with a layer of $TiB_2$ about 300 micrometers thick by micropyretic reaction of a mixture of elemental particulate titanium and boron applied in several layers from a slurry in colloidal alumina and colloidal monoaluminium phosphate. The sample was then treated in a lithium acetate melt as in Example II and lithium compounds were detected in the anthracite under the $TiB_2$ coating.

EXAMPLE XI

A mixture of LiCl and LiF in a weight ratio 67:33 was put in a graphite crucible and melted at 600° C. in a furnace.

A carbon cathode sample (2 cm×2 cm×6 cm) held on a steel rod was immersed in the molten lithium salt mixture and polarized cathodically by means of a current applied to the steel rod with the graphite crucible acting as anode. The cathode current density was 0.3 A/cm2 and the immersed surface area of the sample was 44 cm$^2$. The electrolysis was continued for ½ hour and the cathode sample removed.

Without subsequent treatment, the cathode sample was subjected to an electrolytic test according to Example VIII. No visible damage or swelling were noted on the treated cathode sample after test, whereas an untreated sample was heavily damaged and cracked under similar electrolysis conditions.

EXAMPLE XII

Anthracitic and graphitic carbon cathode samples impregnated according to Example II and comparable nonimpregnated carbon cathode samples were subjected to comparative testing in a graphite crucible containing a molten mixture of sodium fluoride and sodium chloride (30/70 wt %) at 720° C.

Electrolysis was carried out at a nominal cathode current density of 0.1 A/cm$^2$ using the graphite crucible as an anode.

The untreated samples were heavily damaged and cracked after 30 to 60 minutes electrolysis. Treated samples were undamaged after more than 4 hours electrolysis, thus demonstrating the effective protection of the lithium treatment against sodium penetration.

We claim:

1. In a method of producing a carbon cathode for use in aluminum production cells for the electrolysis of alumina dissolved in a cryolite-based molten electrolyte, the improvement comprising the steps of:

treating the carbon cathode to absorb a compound of lithium, by contacting said carbon cathode with a solution, suspension or melt which contains said lithium compound, prior to, during or after forming the carbon cathode, but before the carbon cathode is used for the production of aluminum;

forming Li-C compounds in the carbon cathode by firing the carbon cathode with the lithium compounds therein; and improving thereby the resistance of said carbon cathode to penetration by sodium and molten electrolyte components including cryolite, during the use of said carbon cathode in said aluminum production by the electrolysis of alumina dissolved in a cryolite-based molten electrolyte.

2. The method of claim 1, wherein the carbon is treated with at least one molten salt selected from the group consisting of lithium acetate, carbonate, a mixture of lithium fluoride and lithium lithium chloride, lithium oxalate, lithium formate and lithium aryl.

3. The method of claim 2, wherein the carbon is treated after installation of the cathode.

4. The method of claim 1, wherein the carbon is treated with molten potassium chloride.

5. The method of claim 1, wherein the carbon is treated with at least one solution or a suspension selected from the group consistinq of lithium chloride solution, lithium fluoride solution, lithium borate solution and mixtures thereof.

6. The method of claim 1, wherein at least one compound between carbon and lithium is formed.

7. The method of claim 6, wherein at least one compound corresponding to the formula $LiC_m$ is formed, where m is 2, 4, 6, 12, 18, 36, 64 or 72.

8. The method of claim 1, wherein only that part of the carbon which forms or is nearest to, the cathode surface in direct contact with said molten electrolyte, is treated.

9. The method of claim 1, wherein the cathode is in the form of carbon blocks, which blocks are treated after their formation.

10. The method of claim 1, wherein the carbon is treated prior to installation of the cathode.

11. The method of claim 1, wherein pitch is used to bond carbon particles to form the cathode, said pitch is treated to absorb at least one compound of lithium, before forming the cathode by contacting said pitch with a solution, suspension or melt.

12. The method of claim 1, wherein carbon particles used to form the cathode are treated.

13. The method of claim 12, wherein the treated carbon particles are applied as a coating onto a carbon cathode substrate.

14. The method of claim 12, wherein said treated carbon particles are mixed with other materials selected from the group consisting of colloidal binders and fillers, prior to application to said cathode.

15. The method of claim 14, wherein said materials include a colloidal binder.

16. The method of claim 15, wherein the binder is a colloid containing at least one from the group consisting of silica, alumina, yttria, ceria, thoria, zirconia, magnesia, lithia, hydroxides of the elements listed above, acetates of the elements listed above, formates of the elements listed above, oxides of metals other than those listed above, hydroxides of metals other than those listed above, cationic species and mixtures thereof.

17. The method of claim 14, wherein said materials include at least one filler.

18. The method of claim 17, wherein said fillers are selected from the group consisting of metallic materials, intermetallic materials, semi-metallic materials, polymeric materials, refractory materials, ceramic materials, pyrolizable chlorosilanes, polycarbosilanes, polysilanes and organometal pyropolymers.

19. The method of claim 17, wherein said fillers are selected from the group consisting of. borides, carbides, nitrides, oxides, oxynitrides, and mixtures thereof.

20. The method of claim 1, wherein the cathode is coated with a protective coating containing an aluminium-wettable refractory hard metal compound, before or after treatment of the carbon.

21. The method of claim 20, wherein said protective coating is formed by applying to the carbon cathode a layer of a colloidal slurry containing particulate preformed refractory hard metal compounds or a colloidal slurry containing particulate reactants which form said refractory hard metal compound, and mixtures thereof.

22. The method of claim 1, wherein said treating step comprises cathodically polarizing said cathode in said melt.

23. The method of claim 1, wherein after said treatment and before use of the carbon cathode for the production of aluminum, the carbon cathode is aluminized by exposing it to molten aluminum, with a fluxing agent.

24. An improved carbon cathode, said carbon cathode is treated to absorb at least one compound of lithium by contacting said carbon cathode with a solution, suspension or melt which contains lithium compounds, so as to improve the resistance of said carbon cathode to penetration by sodium and molten electrolyte components including cryolite, by the formation of Li-C compounds in the carbon cathode by firing the carbon cathode with the lithium compounds therein, during the use of said carbon cathode in aluminum production by the electrolysis of alumina dissolved in a cryolite-based molten electrolyte, before the carbon cathode is used for the production of aluminum.

25. In a method of producing a carbon cathode for use in aluminum production by the electrolysis of alumina dissolved in a cryolite-based molten electrolyte, the improvement comprising the steps of:

treating the carbon cathode to absorb at least one compound of lithium by contacting said carbon cathode with a solution, suspension or melt which contains said lithium compounds, during the formation of said carbon cathode; forming Li-C compounds in the carbon cathode by firing the carbon cathode with the lithium compounds therein; and improving thereby the resistance of said carbon cathode to penetration by sodium and molten electrolyte components including cryolite, during the use of said carbon cathode in said aluminum production by the electrolysis of alumina dissolved in a cryolite-based molten electrolyte.

26. In a method of producing aluminum by electrolysis alumina dissolved in a cryolite-based molten electrolyte using an electrolytic cell having an anode and a carbon cathode, the improvement comprising the steps of:

treating the carbon cathode to absorb at least one compound of lithium by contacting said carbon cathode with a solution, suspension or melt which contains said lithium compounds, prior to, during or after forming the carbon cathode, but before the carbon cathode is used for the production of aluminum;

forming Li-C compounds in the carbon cathode by firing the carbon cathode with the lithium compounds therein; and improving thereby the resistance of said carbon cathode to penetration by sodium and molten electrolyte components including cryolite, during the use of said carbon cathode in electrolyzing alumina dissolved in a cryolite-based molten electrolyte to produce alumina.

27. An improved electrolytic cell for producing aluminum by electrolyzing alumina dissolved in a cryolite-based molten electrolyte, comprising an anode and a carbon cathode in contact with the product aluminum, said carbon cathode is treated to absorb at least one compound of lithium by contacting said carbon cathode with a solution, suspension or melt which contains said lithium compounds, to improve the resistance of said carbon cathode to penetration by sodium and molten electrolyte components including cryolite, by the formation of Li-C compounds in the carbon cathode by firing the carbon cathode with the lithium compounds therein, during the use of said carbon cathode in said aluminum production by the electrolysis of alumina dissolved in a cryolite-based molten electrolyte, before the carbon cathode is used for the production of aluminum.

28. In a method of conditioning a carbon cathode for use in aluminum production by the electrolysis of alumina dissolved in a cryolite-based molten electrolyte, to improve the resistance of the carbon cathode to penetration by molten electrolyte components, the improvement comprising the steps of:

treating the carbon cathode to absorb at least one compound of lithium by contacting said carbon cathode with a solution, suspension or melt which contains said lithium compounds, before the carbon cathode is used for the production of aluminum;

forming Li-C compounds in the carbon cathode by firing the carbon cathode with the lithium compounds therein; and improving thereby the resistance of said carbon cathode to penetration by sodium and molten electrolyte components including cryolite, during the use of said carbon cathode in said aluminum production by the electrolysis of alumina dissolved in a cryolite-based molten electrolyte.

29. In a method of reconditioning an electrolytic cell for producing aluminum by the electrolysis of alumina dissolved in a cryolite-based molten electrolyte, the improvement comprising the steps of:

replacing or reconditioning a carbon cathode in contact with the product aluminum, after shutting down the cell;

treating the carbon cathode to absorb at least one compound of lithium by contacting said carbon cathode with a solution, suspension or melt which contains said lithium compounds, prior to, during or after forming a replacement cathode or reconditioning the used cathode, but before re-starting operation of the reconditioned cell;

forming Li-C compounds in the carbon cathode by firing the catbon cathode with the lithium compounds therein; and improving thereby the resistance of said carbon cathode to penetration by sodium and molten electrolyte components including cryolite, during the use of said carbon cathode in said aluminum production by the electrolysis of alumina dissolved in a cryolite-based molten electrolyte.

* * * * *

UNITED STATES PATENT AND TRADEMARK OFFICE

CERTIFICATE OF CORRECTION

PATENT NO. : 5,378,327

DATED : January 3, 1995

INVENTOR(S) : J.A. Sekhar, T. Zheng, J.J. Duruz

It is certified that error appears in the above-identified patent and that said Letters Patent is hereby corrected as shown below:

Column 13, line 23, delete the second "lithium"
Column 14, line 35, insert --said-- between "contains" and "lithium"
Column 14, line 53, "forming Li-C..." should be indented as a separate paragraph
Column 14, lines 62-63, "electrolysis" should be --electrolyzing--
Column 15, line 15, "alumina" should be --aluminum--.

Signed and Sealed this

Sixteenth Day of May, 1995

*Attest:*

Bruce Lehman

BRUCE LEHMAN

*Attesting Officer*

*Commissioner of Patents and Trademarks*